US011976829B2

(12) United States Patent
Yamamoto

(10) Patent No.: US 11,976,829 B2
(45) Date of Patent: May 7, 2024

(54) AIR-CONDITIONING APPARATUS

(71) Applicant: Mitsubishi Electric Corporation, Tokyo (JP)

(72) Inventor: Keiichi Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 459 days.

(21) Appl. No.: 17/289,390

(22) PCT Filed: Jan. 9, 2019

(86) PCT No.: PCT/JP2019/000377
§ 371 (c)(1),
(2) Date: Apr. 28, 2021

(87) PCT Pub. No.: WO2020/144769
PCT Pub. Date: Jul. 16, 2020

(65) Prior Publication Data

US 2022/0003444 A1 Jan. 6, 2022

(51) Int. Cl.
*F24F 11/36* (2018.01)
*F24F 13/20* (2006.01)

(52) U.S. Cl.
CPC ..... *F24F 11/36* (2018.01); *F24F 13/20* (2013.01); *F24F 2013/205* (2013.01); *F24F 2013/207* (2013.01)

(58) Field of Classification Search
CPC ..... F24F 2221/14; F24F 11/36; F24F 13/20; F24F 2013/205; F24F 2013/207; F24F 1/0014; F24F 1/0047
See application file for complete search history.

(56) References Cited

U.S. PATENT DOCUMENTS 10,539,358 B2 * 1/2020 Suzuki ..... F25D 17/067
11,187,424 B2 * 11/2021 Watanabe ..... F24F 11/36
2016/0109162 A1 * 4/2016 Suzuki ..... F24F 11/30 62/498
2016/0348927 A1 * 12/2016 Endo ..... F24F 1/48
(Continued)

FOREIGN PATENT DOCUMENTS

JP 2015-230136 A 12/2015
JP 2016-080220 A 5/2016
(Continued)

OTHER PUBLICATIONS

Extended European Search Report dated Dec. 20, 2021 issued in corresponding European patent application No. 19908805.5.
(Continued)

*Primary Examiner* — Nelson J Nieves
(74) *Attorney, Agent, or Firm* — POSZ LAW GROUP, PLC

(57) ABSTRACT

An air-conditioning apparatus includes: a housing having a first space and a second space that are adjacent to each other; a fan provided in the first space and to suck air into the housing; a heat exchanger provided in the first space and cause heat exchange with the air sucked by the fan to be performed; a refrigerant sensor provided in the second space and to detect refrigerant; and a partition plate provided to partition off the first space and the second space and having an air inlet port and an air outlet port.

6 Claims, 3 Drawing Sheets

(56) References Cited

U.S. PATENT DOCUMENTS

| | | | | |
|---|---|---|---|---|
| 2017/0198936 | A1* | 7/2017 | Yamaguchi | F24F 11/74 |
| 2017/0343258 | A1* | 11/2017 | Yamaguchi | F24F 13/222 |
| 2018/0283718 | A1* | 10/2018 | Honda | F25B 49/005 |
| 2020/0018504 | A1* | 1/2020 | Minamida | F24F 1/0007 |
| 2020/0056799 | A1* | 2/2020 | Tomoigawa | F24F 1/00077 |
| 2020/0318887 | A1* | 10/2020 | Tsutsumi | F24F 13/222 |
| 2020/0393140 | A1* | 12/2020 | Nouchi | F25B 49/02 |

FOREIGN PATENT DOCUMENTS

| | | | |
|---|---|---|---|
| JP | 2017-015324 | A | 1/2017 |
| WO | 2018/198165 | A1 | 11/2018 |

OTHER PUBLICATIONS

International Search Report dated Mar. 5, 2019, issued in corresponding International Patent Application No. PCT/JP2019/000377.

* cited by examiner

AIR-CONDITIONING APPARATUS

CROSS REFERENCE TO RELATED APPLICATION

This application is a U.S. National Stage Application of International Application No. PCT/JP2019/000377, filed on Jan. 9, 2019, the contents of which are incorporated herein by reference.

TECHNICAL FIELD

The present disclosure relates to air-conditioning apparatuses, and in particular, to an air-conditioning apparatus including a refrigerant sensor provided to detect refrigerant that leaks from a refrigerant circuit into a housing.

BACKGROUND ART

In recent years, it has been considered that refrigerant for use in an air-conditioning apparatus is changed to, for example, R32 that has a low global warming potential, in order to take measures against an environmental problem such as global warming or ozone depletion. However, various kinds of refrigerants that are applied in measures against an environmental problem include flammable or mildly flammable refrigerant. Therefore, it has been proposed that a refrigerant sensor is provided in an indoor unit to detect a leak of refrigerant from a refrigerant circuit (see, for example, Patent Literature 1).

CITATION LIST

Patent Literature

Patent Literature 1: Japanese Unexamined Patent Application Publication No. 2017-15324

SUMMARY OF INVENTION

Technical Problem

In an indoor unit described in Patent Literature 1, a leak detection operation in which air is circulated in the indoor unit after an air outlet is closed is performed to detect refrigerant. Because of this operation, it is possible to guide, with airflow, leaking refrigerant to a refrigerant sensor even if a place where a refrigerant leak occurs is located away from a place where the refrigerant sensor is provided. Accordingly, the refrigerant leak can be detected.

However, since the air outlet is open during a normal operation, air does not easily circulate in the indoor unit. As a result, there is a possibility that the refrigerant leak cannot be detected.

The present disclosure is made to solve the above problem, and relates to an air-conditioning apparatus capable of detecting a refrigerant leak even when the refrigerant leak occurs during the operation of the air-conditioning apparatus.

Solution to Problem

An air-conditioning apparatus of an embodiment of the present disclosure includes: a housing having a first space and a second space that are adjacent to each other; a fan provided in the first space and to suck air into the housing; a heat exchanger provided in the first space and to cause heat exchange with the air sucked by the fan to be performed; a refrigerant sensor provided in the second space and to detect refrigerant; and a partition plate that partitions off the first space and the second space, and having an air inlet and an air outlet.

Advantageous Effects of Invention

The air-conditioning apparatus of the embodiment of the present disclosure is capable of detecting a refrigerant leak even during operation of the air-conditioning apparatus.

DESCRIPTION OF EMBODIMENTS

An air-conditioning apparatus according to Embodiment 1 of the present disclosure will be described with reference to the above figures, for example. In each of the figures, components that are the same as or equivalent to those in a previous figure or figures are denoted by the same reference signs, and their descriptions will be omitted or simplified as appropriate. For example, the shapes, sizes, and locations of the components as illustrated in the figures can be changed as appropriate within the scope of the present disclosure.

Embodiment

Figure 1:
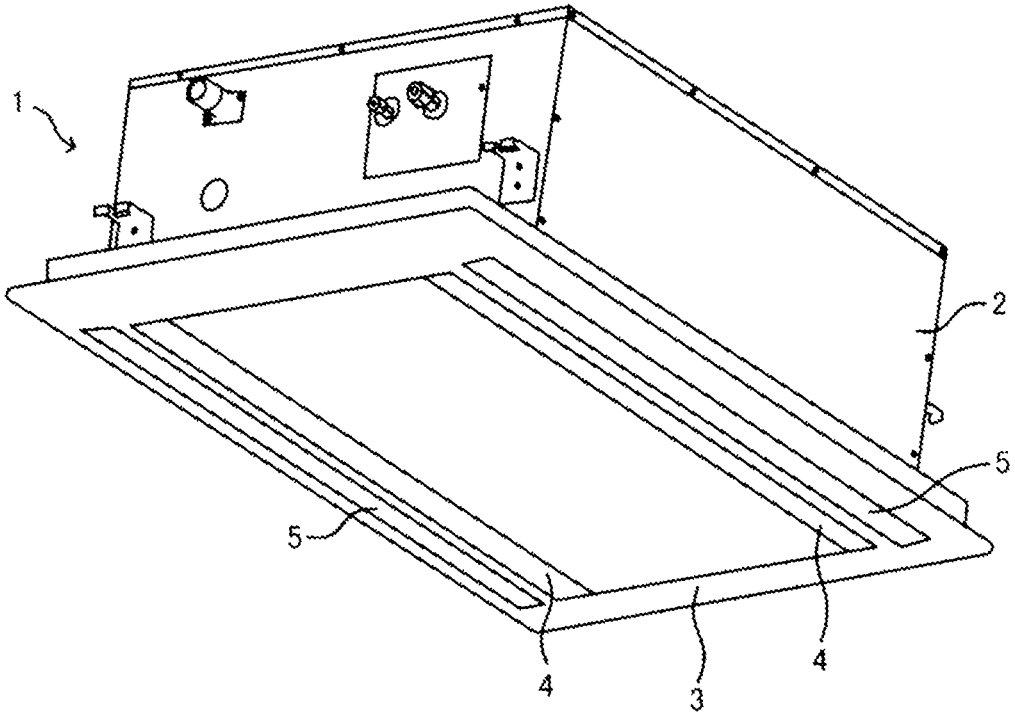
FIG. 1 is a perspective view of an air-conditioning apparatus according to Embodiment 1 of the present disclosure.

FIG. 1 is a perspective view of the air-conditioning apparatus according to Embodiment 1 of the present disclosure. Regarding Embodiment 1, a two-way blowing type indoor unit that has air outlets in two directions and that is at least partially embedded in a ceiling of a room will be described. An air-conditioning apparatus 1 includes a housing 2 and a decorative panel 3. The housing 2 houses components such a fan and a heat exchanger that will descried later; the housing 2 is formed in the shape of a box having an opening portion on a lower side; and the housing 2 is provided in an opening formed in a ceiling. The decorative panel 3 is formed of a rectangular plate body, and is attached to the opening portion of the housing 2 in such a manner as to face an indoor space that is an air-conditioned space. The decorative panel 3 has air inlets 4 and air outlets 5, and the air inlets 4 extend along long sides of the decorative panel 3 to allow indoor air to be sucked. The air inlets 4 are inlets through which indoor air is sucked along the long sides thereof, and air outlets 5 are located outward of the respective air inlets 4 and allow air conditioned in the air-conditioning apparatus 1 to blow out to the indoor space. The air-conditioning apparatus 1 is connected to an outdoor unit (not illustrated) by a refrigerant pipe and circulates refrigerant between the air-conditioning apparatus 1 and the outdoor unit.

Figure 2:
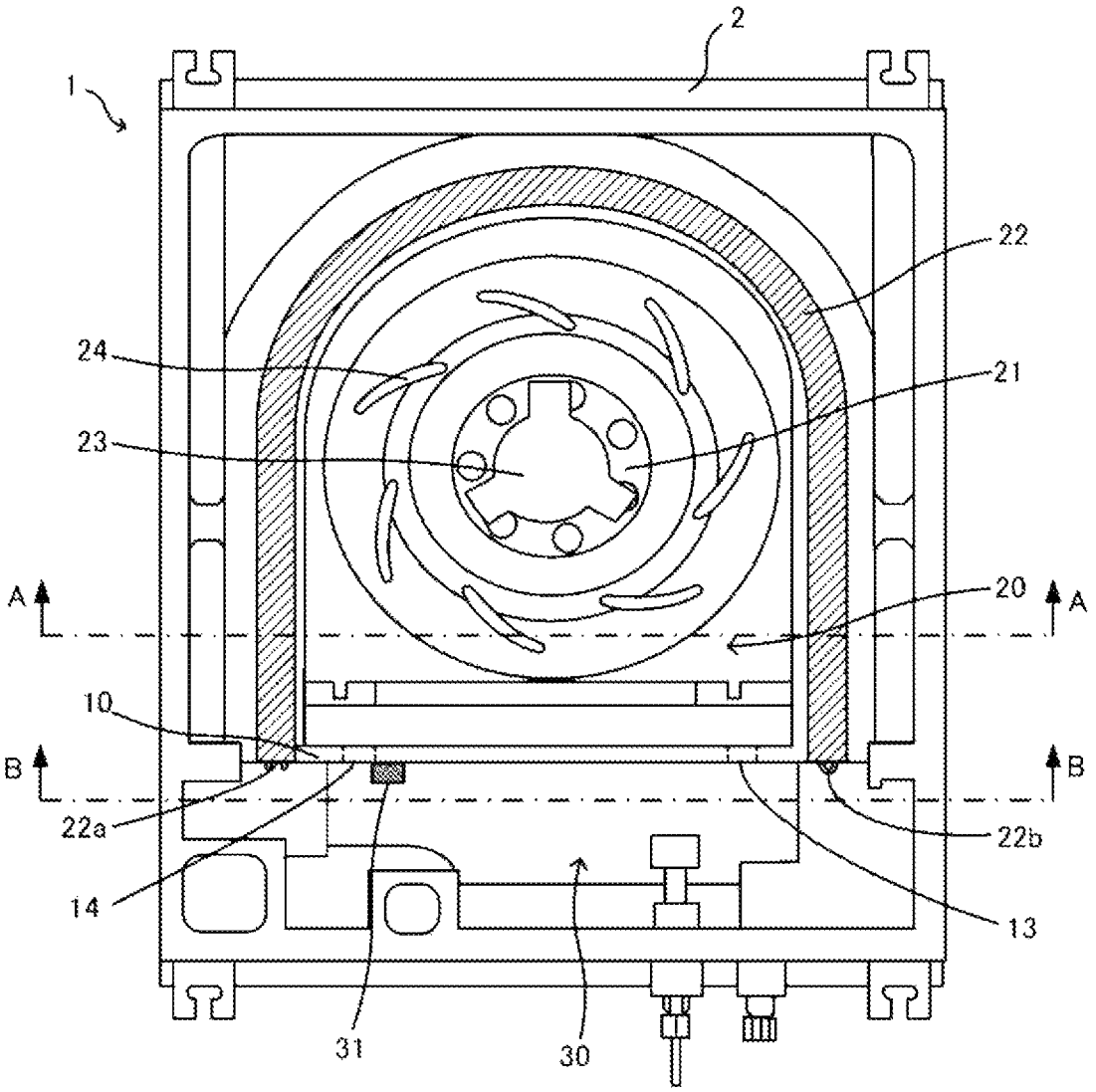
FIG. 2 is a top view of the air-conditioning apparatus as illustrated in FIG. 1.

FIG. 2 is a top view of the air-conditioning apparatus as illustrated in FIG. 1. FIG. 2 is a view of the housing 2 that is obtained as viewed from above, with an upper surface of the housing 2 removed from the housing 2. The housing 2 has a first space 20 in which a fan 21 and a heat exchanger 22 are provided and a second space 30 in which a refrigerant sensor 31 and a pipe (not illustrated) are provided. The first space 20 and the second space 30 are adjacent to each other in parallel with a surface of the ceiling and along the air inlets 4 and the air outlets 5. The first space 20 and the second space 30 are partitioned off by a partition plate 10.

Figure 3:
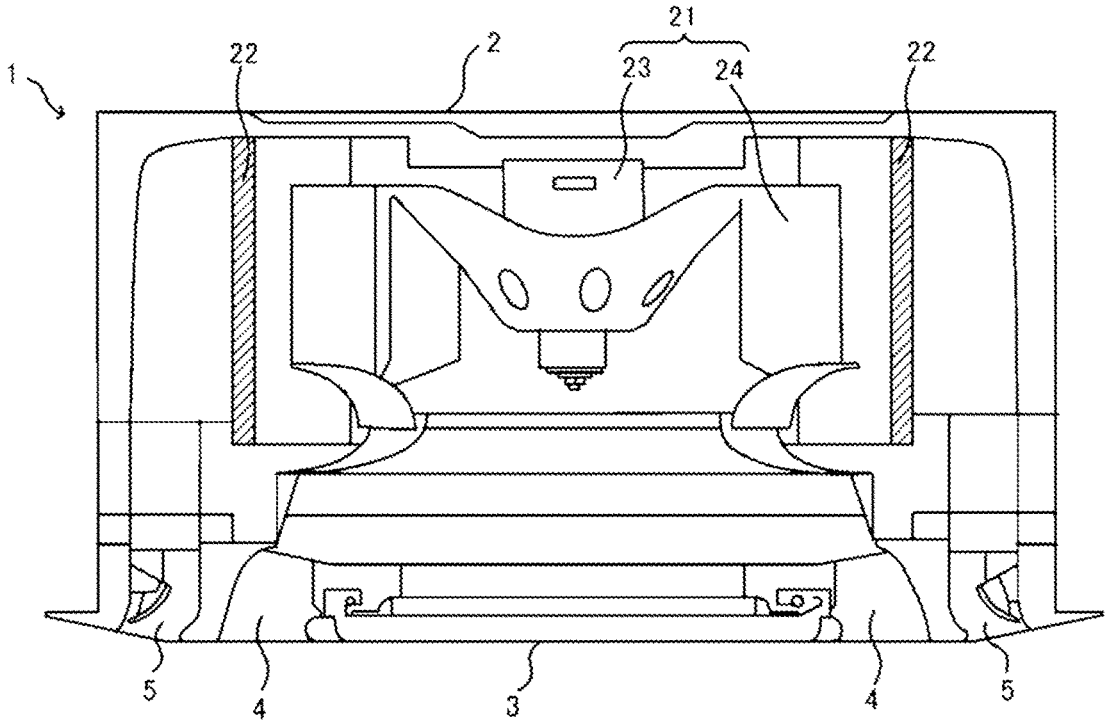
FIG. 3 is a side view illustrating a section taken along line A-A in FIG. 2, as viewed in a direction indicated by arrows for the line A-A.
Figure 4:
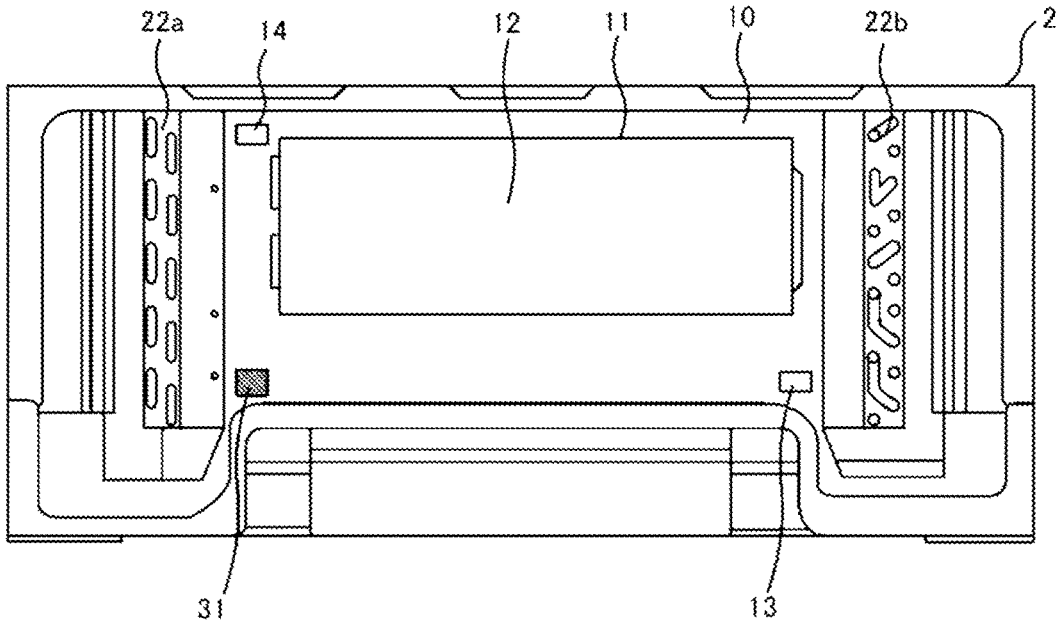
FIG. 4 is a side view illustrating a section taken along line B-B in FIG. 2, as viewed in a direction indicated by arrows for the line B-B.

FIG. 3 is a side view illustrating a section taken along line A-A in FIG. 2, as viewed in a direction indicated by arrows for the line A-A. FIG. 4 is a side view illustrating a section taken along line B-B in FIG. 2, as viewed in a direction indicated arrows for line B-B. The fan 21 sucks indoor air into the housing 2 through the air inlets 4, and blows conditioned-air into the indoor space through the air outlets 5 after the conditioned-air is obtained by causing the air to be subjected to heat exchange. The fan 21 includes a motor 23 and a fan 24. When the motor 23 is driven, the fan 24 is rotated to generate airflow.

The heat exchanger 22 causes heat exchange to be performed between air sucked by the fan 21 and refrigerant, and is provided downstream of the fan 21 in the flow of air and in such a manner as to surround the fan 21. The heat exchanger 22 is, for example, a finned tube heat exchanger. The heat exchanger 22, a compressor, a four-way valve, an outdoor heat exchanger, an expansion valve, and other components not illustrated, form a refrigeration cycle circuit. At least the compressor and the outdoor heat exchanger of the refrigeration cycle circuit are mounted together with an outdoor fan in the outdoor unit. The outdoor fan sends outside air to the outdoor heat exchanger. In a cooling operation, the heat exchanger 22 operates as an evaporator, and when the air sent by the fan 21 passes through the heat exchanger 22, the air exchanges with refrigerant and is thus cooled. On the other hand, in a heating operation, the heat exchanger 22 operates as a condenser, and when the air sent by the fan 21 passes through the heat exchanger 22, the air exchanges with refrigerant and is thus heated. As the refrigerant, a low-GWP refrigerant that is hydrochlorofluorocarbon such as R32, and that is, for example, a flammable or mildly flammable refrigerant, is used. In Embodiment 1, R32 is used.

The heat exchanger 22 of Embodiment 1 has a section that has such a substantially U-shape as to surround three sides of an outer periphery of the fan 21. Between one end portion 22*a* and another end portion 22*b* of the heat exchanger 22, the partition plate 10, which is formed in the shape of a flat rectangular plate, is provided to cover the other side of the fan 21. That is, the entire outer periphery of the fan 21 is surrounded by the heat exchanger 22 and the partition plate 10.

The partition plate 10 partitions off the first space 20 in which the fan 21 and the heat exchanger 22 are located and the second space 30 in which the refrigerant sensor 31 and the pipe (not illustrated) are located. In the partition plate 10, a rectangular opening portion 11 is formed. The opening portion 11 has, for example, a length of approximately 30 to 40 cm in a horizontal direction and a length of approximately 10 to 15 cm in a vertical direction. The opening portion 11 is closed by a maintenance panel 12. The maintenance panel 12 has a size greater than or nearly equal to the size of the opening portion 11. The maintenance panel 12 is detachably attached to the partition plate 10 by, for example, screws. The maintenance panel 12 is detached for cleaning of the fan 21 or maintenance of a drain pan provided below the heat exchanger 22. In the other cases (including the case in which the air-conditioning apparatus 1 is in operation), the maintenance panel 12 is attached to the partition plate 10 to close the opening portion 11.

Furthermore, an air inlet port 13 and an air outlet port 14 are formed in the partition plate 10. The air inlet port 13 and the air outlet port 14 are, for example, openings each having a rectangular shape and having a length of approximately 1 to 3 cm in the horizontal direction and a length of approximately 1 to 3 cm in the vertical direction. The air inlet port 13 is an opening through which air flows from the first space 20 into the second space 30, and is formed in a lower portion of the partition plate 10 where the pressure of air from the fan 21 is high. The air outlet port 14 is an opening through which air flows from the second space 30 into the first space 20, and is formed in an upper portion of the partition plate 10 where the pressure of air from the fan 21 is low. At the portion where the air inlet port 13 is formed, the pressure of air from the fan 21 is higher than that at the portion where the air outlet port 14 is formed. It is therefore possible to cause some of air sucked into the first space 20 to flow into the second space 30 through the air inlet port 13.

The refrigerant sensor 31 is provided in the second space 30 and is configured to detect whether refrigerant is contained in air in the second space 30 or not. To detect refrigerant efficiently, preferably, the refrigerant sensor 31 should be provided at a position in the second space 30 where refrigerant easily collects. Thus, the refrigerant sensor 31 is provided in a lower region in the second space 30 and closer to the air outlet port 14 than to the air inlet port 13.

Next, an air-conditioning operation of the air-conditioning apparatus 1 according to Embodiment 1 will be briefly described. In the cooling operation, high-temperature and high-pressure gas refrigerant that is discharged from the compressor of the refrigeration cycle circuit after being obtained by compression performed by the compressor flows into the outdoor heat exchanger (condenser) via the four-way valve. The gas refrigerant that has flowed into the outdoor heat exchanger exchanges heat with outside air sent by the outdoor fan to condense into low-temperature refrigerant. The low-temperature refrigerant then flows out of the outdoor heat exchanger. The refrigerant that has flowed out of the outdoor heat exchanger is expanded and reduced in pressure by an expansion device to change into low-temperature and low-pressure two-phase gas-liquid refrigerant. The two-phase gas-liquid refrigerant flows into the heat exchanger 22 (evaporator) and exchanges heat with indoor air sent by the fan 21 to evaporate and change into low-temperature and low-pressure gas refrigerant. The low-temperature and low pressure gas refrigerant flows out of the heat exchanger 22. In the above heat exchange, heat from the indoor air is received by the refrigerant and the indoor air is cooled. The cooled indoor air is blown as cold air into the indoor space. The gas refrigerant that has flowed of the heat exchanger 22 is sucked into the compressor via the four-way valve and is re-compressed. In the refrigeration cycle circuit, during the cooling operation, the above series of operations are continuously repeated.

By the fan 21, indoor air is sucked into the air-conditioning apparatus 1 through the air inlets 4 and is then blown out from the air-conditioning apparatus 1. To be more specific, the air sucked by the fan 21 passes through the heat exchanger 22 and is cooled. The air is then blown out as cold air into the indoor space through the air outlets 5.

In the heating operation, high-temperature and high-pressure gas refrigerant discharged from the compressor after being obtained by compression by the compressor flows into the heat exchanger 22 (condenser) via the four-way valve. The gas refrigerant that has flowed into the heat exchanger 22 exchanges heat with indoor air sent by the fan 21 to condense into low-temperature refrigerant, and then the low-temperature refrigerant flows out of the heat exchanger 22. In the above heat exchange, the indoor air receives heat from the refrigerant and is thus heated, and is then blown out as warm air into the indoor space. The above refrigerant that has flowed out of the heat exchanger 22 is expanded and reduced in pressure by the expansion device to change into low-temperature and low-pressure two-phase gas-liquid refrigerant. The two-phase gas-liquid refrigerant flows into the outdoor heat exchanger (evaporator) and exchanges heat with outside air sent by the outdoor fan to evaporate and change into low-temperature and low-pressure gas refrigerant. The low-temperature and low-pressure gas refrigerant flows out of the outdoor heat exchanger. The gas refrigerant that has flowed out of the outdoor heat exchanger is sucked into the compressor via the four-way valve and is re-compressed. In the refrigeration cycle circuit, in the heating operation, the above series of operations are continuously repeated.

By the fan 21, indoor air is sucked into the air-conditioning apparatus 1 through the air inlets 4 and is flown out of the air-conditioning apparatus 1. To be more specific, the air sucked by the fan 21 passes through the heat exchanger 22 and is heated. The air is blown out as warm air into the indoor space through the air outlets 5.

Next, the following description is made with respect to the air-conditioning operation in the case where refrigerant leaks into the air-conditioning apparatus 1 during the cooling operation or the heating operation. Regarding Embodiment 1, the air-conditioning operation in the case where refrigerant leaks from the heat exchanger 22 located in the first space 20 will be described. When refrigerant leaks from the heat exchanger 22 in the first space 20, the refrigerant is mixed into air sucked by the fan 21. Some of the air containing the refrigerant flows from the first space 20 into the second space 30 through the air inlet port 13. When the air containing the refrigerant flows into the second space 30, the refrigerant sensor 31 detects the refrigerant and makes a notification indicating this refrigerant leak.

The air inlet port 13 is formed at a location where the pressure of air from the fan 21 is higher than that at the air outlet port 14. Because of this configuration, the air containing refrigerant in the first space 20 easily flows into the second space 30, in which the refrigerant sensor 31 is provided, through the air inlet port 13.

Furthermore, the air inlet port 13 is provided in the lower portion of the partition plate 10. Because of this configuration, since R32 refrigerant adopted in Embodiment 1 has a higher specific gravity than that of air, the concentration of refrigerant in a lower region of the air-conditioning apparatus is higher and air that contains refrigerant such that the concentration of the refrigerant is higher can thus be made to flow into the second space 30.

Furthermore, the air outlet port 14 is provided in the upper portion of the partition plate 10. Because of this configuration, since the R32 refrigerant adopted in Embodiment 1 has a higher specific gravity than that of air, and the concentration of the refrigerant in an upper region in the air-conditioning apparatus 1 is lower, and air that contains refrigerant such that the concentration of the refrigerant is lower can be made to flow into the first space 20. That is, the air inlet port 13 is provided at a lower location than the air outlet port 14, and the concentration of the refrigerant in the second space 30 can thus be increased, and the accuracy of refrigerant detection by the refrigerant sensor 31 can be improved.

It is preferable that the area of the air inlet port 13 be larger than that of the air outlet port 14. Because of this configuration, air containing refrigerant in the first space 20 easily flows into the second space 30, and the air containing refrigerant does not easily flow from the second space 30 into the first space 20; that is, the air containing refrigerant can be stayed in the second space 30 and the accuracy of refrigerant detection by the refrigerant sensor 31 can be improved.

The refrigerant sensor 31 is provided in the lower region in the second space 30. Because of this configuration, the accuracy of the refrigerant detection can be improved, since the R32 refrigerant adopted in Embodiment 1 has a specific gravity higher than that of air, and the concentration of the refrigerant in a lower region in the air-conditioning apparatus 1 is thus higher.

In addition, the refrigerant sensor 31 is provided closer to the air outlet port 14 than to the air inlet port 13. This location is not easily affected by air from the air inlet port 13, and air gently flows at the location. It is therefore possible to improve the accuracy of refrigerant detection.

Furthermore, it is preferable that the refrigerant sensor 31 be provided below the air outlet port 14 and adjacent to the partition plate 10. By applying this configuration, it is possible to improve the accuracy of refrigerant detection, because the refrigerant sensor 31 is provided at a position where refrigerant easily collects. It should be noted that the refrigerant sensor 31 does not need to be completely adjacent to the partition plate 10, and it suffices that the refrigerant sensor 31 is provided in the vicinity of the partition plate 10.

As described above, the air-conditioning apparatus 1 according to Embodiment 1 includes the housing 2 in which the first space 20 and the second space 30 are provided adjacent to each other, and that includes: the fan 21 that is provided in the first space 20 and sucks air into the housing 2; the heat exchanger 22 that is provided in the first space 20 and causes heat exchange to be performed between air sucked by the fan 21 and refrigerant; the refrigerant sensor 31 that is provided in the second space 30 and detects refrigerant; and the partition plate 10 that partitions off the first space 20 and the second space 30 and has the air inlet port 13 and the air outlet port 14.

In the above configuration, even when refrigerant leaks during the operation of the air-conditioning apparatus, this refrigerant leak can be detected.

In the air-conditioning apparatus 1 according to Embodiment 1, the air inlet port 13 is provided at a location where the pressure of air from the fan 21 is higher than that at the air outlet port 14.

In the above configuration, air containing refrigerant in the first space 20 easily flows into the second space 30 in which the refrigerant sensor 31 is provided, through the air inlet port 13.

In the air-conditioning apparatus 1 according to Embodiment 1, the refrigerant has a higher specific gravity than that of air, the refrigerant sensor 31 is provided in the lower region in the second space 30, and the air inlet port 13 is provided below the air outlet port 14.

Because of the above configuration, the refrigerant concentration in the second space 30 can be increased, and the accuracy of refrigerant detection by the refrigerant sensor 31 can be improved, because an R32 refrigerant has a higher specific gravity than that of air and the refrigerant concentration in the lower region in the air-conditioning apparatus 1 is increased.

In the air-conditioning apparatus 1 according to Embodiment 1, the area of the air inlet port 13 is larger than the area of the air outlet port 14.

Because of this configuration, air containing refrigerant can be stayed in the second space 30, and the accuracy of refrigerant detection by the refrigerant sensor 31 can be improved.

In the air-conditioning apparatus 1 according to Embodiment 1, the refrigerant sensor 31 is provided closer to the air outlet port 14 than to the air inlet port 13, and located below the air outlet port 14.

Because of this configuration, the above location is not easily affected by air from the air inlet port 13, and air gently flows at the location. It is therefore possible to improve the accuracy of refrigerant detection.

In the air-conditioning apparatus 1 according to Embodiment 1, the refrigerant sensor 31 is provided adjacent to the partition plate 10.

In this configuration, since the refrigerant sensor 31 is located at a position where refrigerant easily collects, the accuracy of refrigerant detection can be improved.

The present disclosure is applied with respect to Embodiment 1. The technical scope of the present disclosure is not limited to the scope as described above regarding Embodiment 1. Embodiment 1 can be variously modified or improved without departing from the subject matter of the present disclosure, and such modified or improved embodiments also fall within the technical scope of the present disclosure.

Although, for example, regarding Embodiment 1, a two-way blowing type indoor unit is described above as the air-conditioning apparatus 1, an indoor unit having air outlets in four directions may be used.

REFERENCE SIGNS LIST

1 air-conditioning apparatus 2 housing 3 decorative panel 4 air inlet air outlet 10 partition plate 11 opening portion 12 maintenance panel 13 air inlet port 14 air outlet port 20 first space 21 fan 22 heat exchanger 22*a* one end portion 22*b* another end portion 23 motor 24 fan 30 second space 31 refrigerant sensor

The invention claimed is:

1. An air-conditioning apparatus comprising:

a housing having a first space and a second space that are adjacent to each other;

a fan provided in the first space, and configured to suck air into the housing;

a heat exchanger provided in the first space, and configured to cause heat exchange to be performed between the air sucked by the fan and refrigerant;

a refrigerant sensor provided in the second space, and configured to detect the refrigerant; and a partition plate provided to partition off the first space and the second space, and having an air inlet port and an air outlet port, wherein the refrigerant has a higher specific gravity than air, the refrigerant sensor is provided in a lower region in the second space, and the air inlet port is provided below the air outlet port.

2. The air-conditioning apparatus of claim 1, wherein the air inlet port is provided at a location where a pressure of air from the fan is higher than at the air outlet port.

3. The air-conditioning apparatus of claim 1, wherein an area of the air inlet port is larger than an area of the air outlet port.

4. The air-conditioning apparatus of claim 1, wherein the refrigerant sensor is provided closer to the air outlet port than to the air inlet port and located below the air outlet port.

5. The air-conditioning apparatus of claim 4, wherein the refrigerant sensor is provided adjacent to the partition plate.

6. The air-conditioning apparatus of claim 1, wherein the first space and the second space are adjoining each other.

* * * * *